US005332377A

United States Patent [19]

Hirayama et al.

[11] Patent Number: 5,332,377

[45] Date of Patent: Jul. 26, 1994

[54] COMPRESSOR WITH OVERSIZED BLADE

[75] Inventors: Takuya Hirayama; Masayuki Okuda, both of Kanagawa, Japan

[73] Assignee: Kabushiki Kaisha Toshiba, Kawasaki, Japan

[21] Appl. No.: 879,005

[22] Filed: May 6, 1992

[30] Foreign Application Priority Data

May 9, 1991 [JP] Japan ..... 3-104523

[51] Int. Cl.[5] ..... F01C 21/08

[52] U.S. Cl. ..... 418/220; 417/355

[58] Field of Search ..... 418/220, 172; 417/355, 417/356

[56] References Cited

U.S. PATENT DOCUMENTS 2,401,189 5/1946 Quiroz ..... 103/177
3,274,944 9/1966 Parsons .
4,871,304 10/1989 Iida et al. ..... 418/220
5,141,423 8/1992 Aikawa et al. ..... 418/220

FOREIGN PATENT DOCUMENTS 0376049 7/1990 European Pat. Off. .
0067490 3/1990 Japan ..... 418/220

OTHER PUBLICATIONS

Patent Abstracts of Japan vol. 14, No. 91 (M-938)(4034) of Feb. 20, 1990.

*Primary Examiner*—Richard A. Bertsch
*Assistant Examiner*—Charles Freay
*Attorney, Agent, or Firm*—Foley & Lardner

[57] ABSTRACT

A fluid compressor comprises a cylinder, a cylindrical piston eccentrically disposed inside the cylinder so that the periphery of the piston is partly in contact with the inner face of the cylinder, the piston being movable relative to the cylinder, a spiral groove formed around the piston at pitches that gradually reduce from a suction side toward a discharge side, and a spiral blade fitted in the groove so that the blade is outwardly and inwardly movable in the groove, the blade defining a plurality of work chambers between the inner face of the cylinder and the periphery of the piston. The outer diameter of at least part of the blade is larger than the inner diameter of the cylinder.

5 Claims, 7 Drawing Sheets

COMPRESSOR WITH OVERSIZED BLADE

BACKGROUND OF THE INVENTION

1. Field of the Invention

The present invention relates to a spiral blade type fluid compressor for compressing a fluid such as a coolant gas in a refrigerating cycle.

2. Description of the Prior Art

Compressors are usually classified into a reciprocation type and a rotary type. In addition to these two types, there is a spiral blade type compressor, which successively moves a coolant from the suction side of a cylinder toward the discharge side thereof through work chambers to compress the coolant, and discharges the compressed coolant outside.

Such a conventional spiral blade type compressor will be explained with reference to FIG. 1.

The compressor has drive means 105 including a stator 101 and a rotor 103. The drive means 105 turns a cylinder 107. The cylinder incorporates a piston 111. The piston 111 is eccentric to the cylinder 107 by a distance of e, so that the piston 111 may rotate relative to the cylinder 107 through an oldham ring 109.

A spiral groove 113 is formed around the periphery of the piston 111 substantially over the whole length of the piston 111. A blade 115 is movably fitted in the groove 113. The periphery of the blade 115 is in contact with the inner face of the cylinder 107.

The blade 115 fitted to the spiral groove 113 defines a plurality of work chambers 117 in a space between the piston 111 and the cylinder 107. The volume of each work chamber 117 is determined by a corresponding pitch of the spiral groove 113. The pitches of the groove 113 gradually shorten from the suction side of the piston 111 toward the discharge side thereof. Namely, the volumes of the work chambers 117 defined by the blade 115 gradually decrease from the suction side (the right-hand side in the figure) toward the discharge side (the left-hand side in the figure), so that the coolant is gradually compressed while being conveyed from the suction side toward the discharge side.

The blade 115 moves inwardly and outwardly in the spiral groove 113, so that the periphery of the blade 115 is partly in contact with the inner face of the cylinder 107, to seal the work chambers 117.

Discharge capacity of the compressor is determined by the volume of the work chamber 117 defined at the suction side. To increase a refrigerant, a pitch of the blade 115 for the work chamber at the suction side must be extended.

FIG. 2 shows the blade 115. Compared with a small pitch region (the left-hand side in the figure) of the blade 115, a large pitch region (the right-hand side in the figure) involves large twists 119, which may be strongly pressed against the wall of the spiral groove 113. Contact pressure between the twists 119 and the groove 113 produces sliding resistance that prevents smooth movements of the blade 115 in the groove 113. If the blade 115 does not smoothly move in the groove 113, the periphery of the blade 115 will not be in tight contact with the inner face of the cylinder 107. This will break the sealed state of the work chambers 117 and deteriorate the discharge capacity.

SUMMARY OF THE INVENTION

To solve the problem, an object of the invention is to provide a fluid compressor that improves airtightness between a cylinder and a blade and increases discharge capacity.

In order to accomplish the object, the invention provides a fluid compressor comprising a cylinder driven by a drive unit and having a suction port and a discharge port; a cylindrical piston eccentrically disposed in the cylinder so that the periphery thereof may partly be in contact with the inner face of the cylinder and movable relative to the cylinder; a spiral groove formed around the piston at pitches that gradually reduce from the suction port side toward the discharge port side; and a spiral blade movably fitted in the spiral groove to define a plurality of work chambers between the inner face of the cylinder and the periphery of the piston. The outer diameter of the blade at least at the suction port side is greater than the inner diameter of the cylinder.

In this fluid compressor, the blade fitted in the spiral groove is in contact with the inner face of the cylinder, to define the work chambers. Since the outer diameter of the blade at the suction port side is larger than the inner diameter of the cylinder, a strong restoring force acts on the blade. Due to this restoring force, the blade can smoothly move outwardly and inwardly in the groove even if sliding resistance occurs between the blade and the wall of the spiral groove. Accordingly, the periphery of the blade is surely in contact with the inner face of the cylinder, to tightly seal the work chambers.

These and other objects, features and advantages of the present invention will be more apparent from the following detailed description of preferred embodiments in conjunction with the accompanying drawings.

DETAILED DESCRIPTION OF THE EMBODIMENTS

An embodiment of the invention will be explained in detail with reference to FIGS. 3 through 13.

Figure 7:
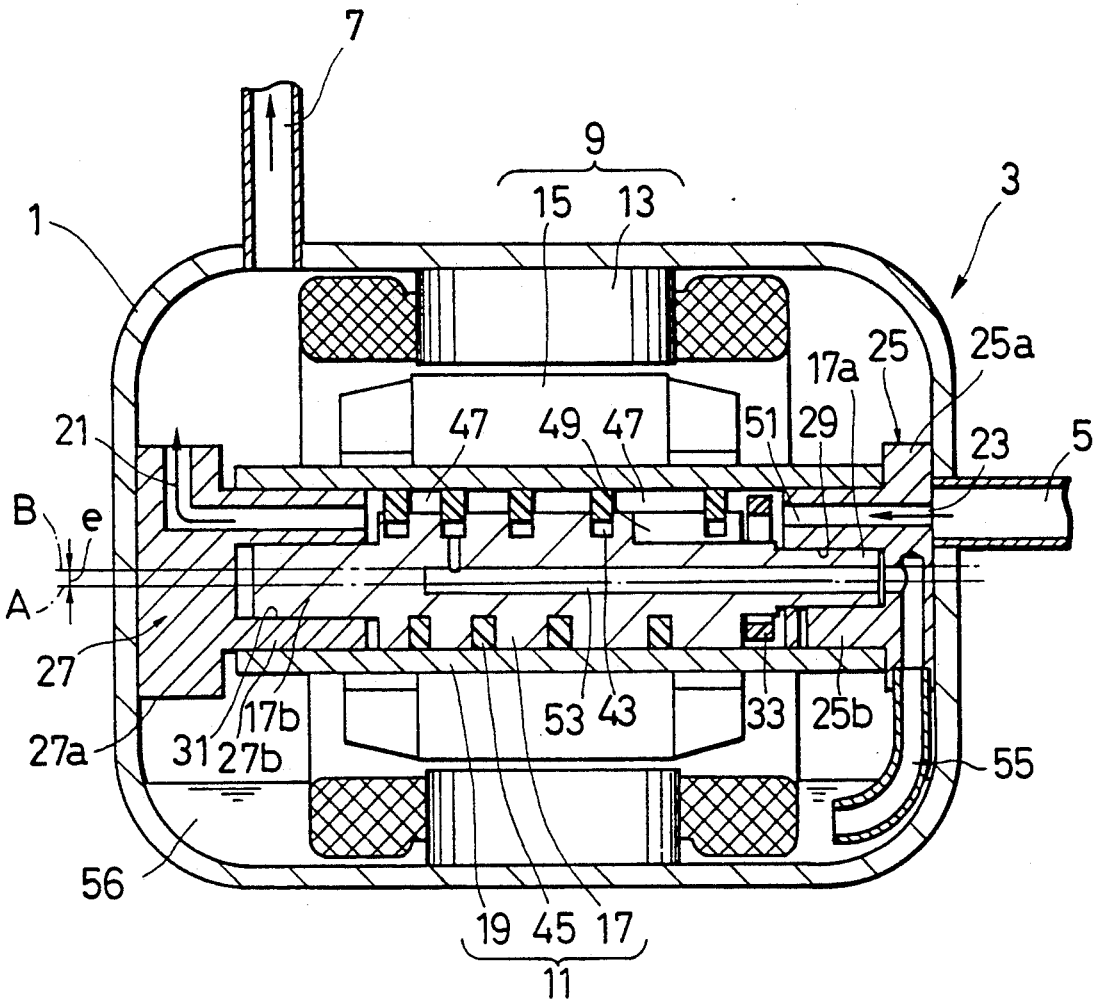
FIG. 7 is a sectional view showing the fluid compressor according to the invention.

FIG. 7 is a sectional view showing a closed type fluid compressor 3 according to the invention. This compressor is used in a refrigerating cycle. The compressor 3 has a closed case 1 having a suction pipe 5 and a discharge pipe 7. The closed case 1 incorporates a drive unit 9 and a compressing element 11.

The drive unit 9 includes a stator 13 fixed to the inner face of the case 1, and a rotor 15 rotatably disposed in the stator 13.

The compressing element 11 comprises a piston 17 and a cylinder 19. The cylinder 19 is fixed to the rotor 15 and has open ends. One of the open ends on the left-hand side in the figure forms a discharge port 21, and the other open end forms a suction port 23.

The piston 17 has a cylindrical shape made of iron-based material. The piston 17 is disposed inside the cylinder 19 along an axis of the cylinder 19. A center axis A of the piston 17 is eccentric to a center axis B of the cylinder 19. Namely, the axis A is downwardly displaced from the axis B by a distance of e, so that part of the piston 17 is in linear contact with the inner face of the cylinder 19.

Ends of the piston 17 form support portions 17*a* and 17*b*, which are supported by first and second support members 25 and 27, respectively.

The first support member 25 comprises a flange 25*a* fixed to the inner face of the case 1, and a cylindrical bearing portion 25*b* protruding from the flange 25*a*. One end opening of the cylinder 19 is rotatably fitted over the bearing portion 25*b*. The bearing portion 25*b* has an inner bearing hole 29 into which the support portion 17*a* of the piston 17 is rotatably inserted. In this supporting structure, each bearing face is sealed.

The second support member 27 comprises a flange 27*a* fixed to the inner face of the case 1, and a cylindrical bearing portion 27*b* protruding from the flange 27*a*. The bearing portion 27*b* has an inner bearing hole 31 into which the support portion 17*b* of the piston 17 is rotatably inserted.

An oldham ring 33 is fitted to the piston 17. A driving force is transmitted to the oldham ring 33 through the rotor 15 and cylinder 19.

Figure 9:
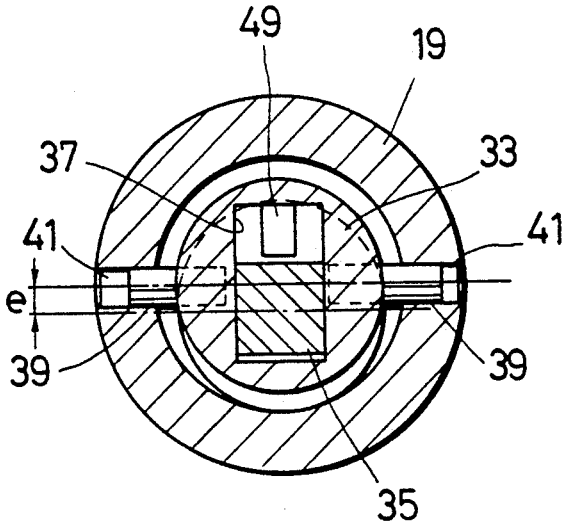
FIG. 9 is a sectional view showing an oldham ring.

FIG. 9 shows the details of the oldham ring 33.

In the figure, the piston 17 has a square portion 35 having a square cross section for providing power transmission faces. The oldham ring 33 has a rectangular long hole 37 into which the square portion 35 of the piston 17 is inserted with a clearance between them. Due to the clearance, the square portion 35 of the piston 17 can slide in the long hole 37 of the oldham ring 33.

The periphery of the oldham ring 33 has holes for receiving one ends of a pair of transmission pins 39. The pins are free to slide in the holes in a diametral direction orthogonal to the longitude of the long hole 37. The other ends of the transmission pins 39 are fixed in holes 41 formed on the inner wall of the cylinder 19. This arrangement restricts the piston 17 from revolving.

When the drive unit 9 is energized, the cylinder 19 rotates with the rotor 15, and the oldham ring 33 produces a relative speed difference between the periphery of the piston 17 and the inner face of the cylinder 19. The relative speed difference changes in a one-turn period, and the piston 17 turns in the cylinder 19. Namely, the piston 17 turns relative to the cylinder 19 at the eccentric position distanced from the axis of the cylinder 19 by e.

Figure 8:
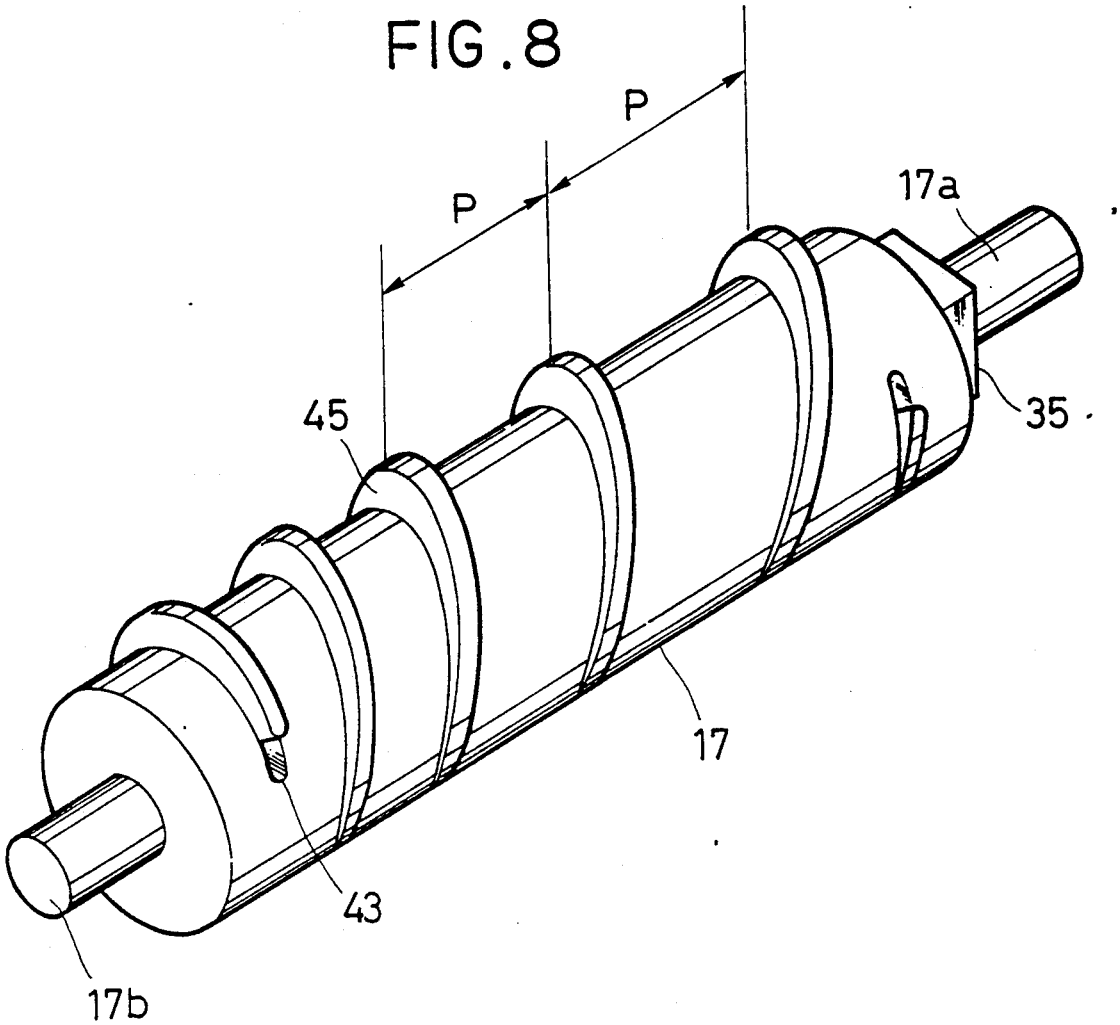
FIG. 8 is a perspective view showing the piston.

FIG. 8 shows the details of the piston 17.

A spiral groove 43 is formed around the piston 17 and extends in an axial direction. Pitches P of the spiral groove 43 gradually reduce from the suction port 28 (the right-hand side in FIG. 7) toward the discharge port 21 (the left-hand side in the same figure). A spiral blade 45 is fitted in the spiral groove 43. The blade 45 is made of elastic synthetic resin. Due to the elasticity, the blade 45 is movable inwardly and outwardly in the groove 43.

Figure 1:
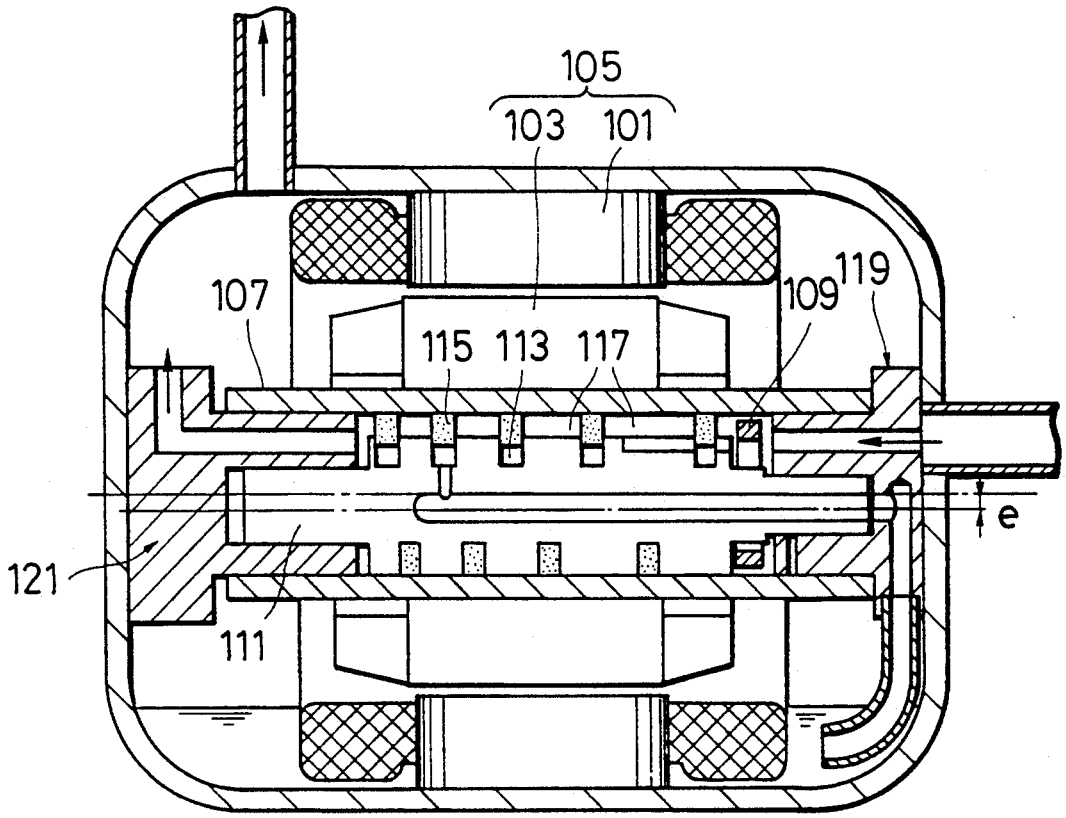
PRIOR ART FIG. 1
FIG. 1 is a sectional view showing a fluid compressor according to a prior art.
Figure 2:
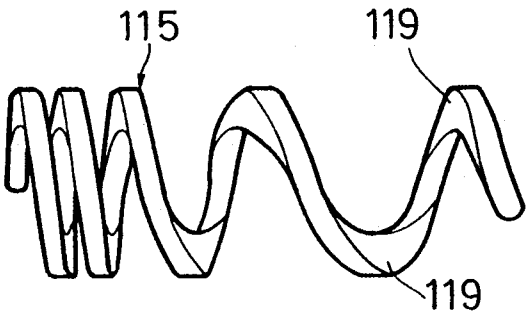
PRIOR ART FIG. 2
FIG. 2 is a side view showing a blade according to the prior art.
Figure 3:
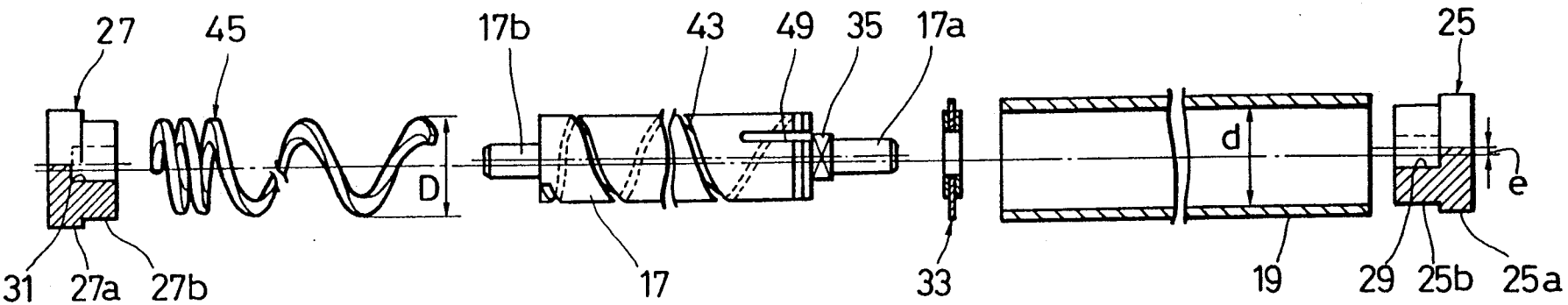
FIG. 3 is an exploded view showing a cylinder and a piston of a fluid compressor according to the invention.
Figure 4:
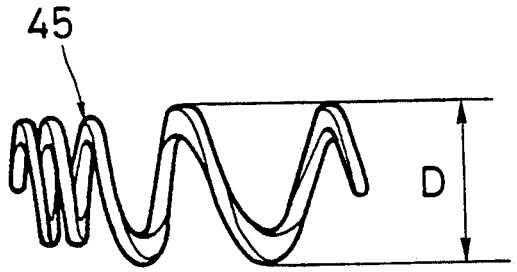
FIG. 4 is a side view showing the blade of FIG. 3.

FIG. 3 is an exploded view showing the piston 17, cylinder 19, and blade 45. In this figure and in FIG. 4, an outer diameter D of the blade 45, particularly at the suction port 23 with a large pitch P, is larger than an inner diameter d of the cylinder 19.

Figure 5:
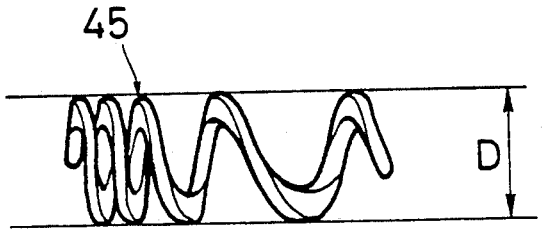
FIG. 5 is a side view showing a blade according to a modification of the invention.

FIG. 5 shows a modification of the blade 45. This blade has a uniform diameter D which is larger than the inner diameter d of the cylinder 19.

Figure 6:
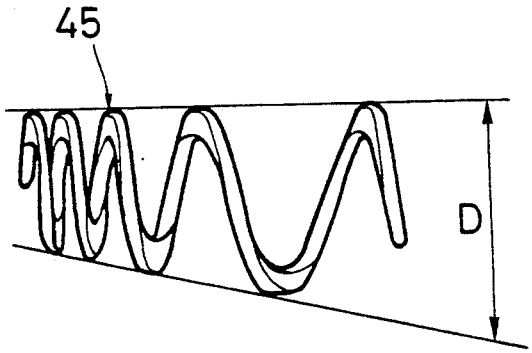
FIG. 6 is a side view showing a blade according to another modification of the invention.

FIG. 6 shows another modification of the blade 45. This blade has a tapered shape with diameters gradually increasing from the discharge port 21 with a smaller pitch P toward the suction port 23 with a larger pitch P.

The blade 45 rotates substantially at the same angular speed as that of the cylinder 19, so that no relative displacement occurs between the blade 45 and the cylinder 19. While the blade 45 is turning, it repeats outward and inward movements in the spiral groove 43.

Figure 10:
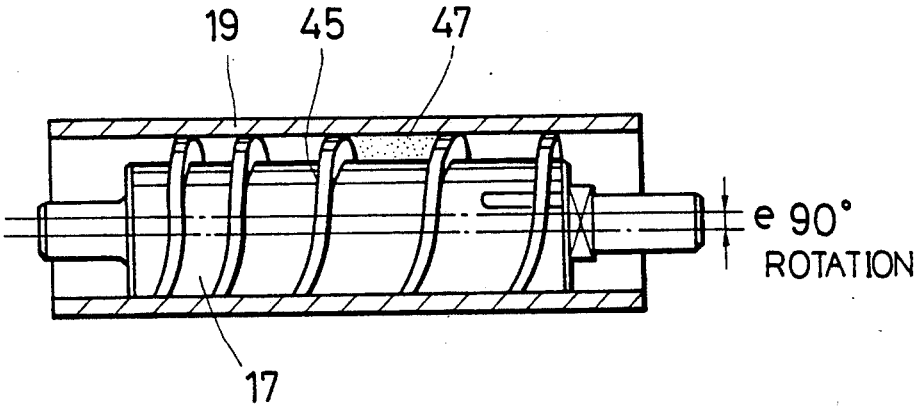
FIG. 10 is a view showing a 90-degree turned state of essential part of the compressor of the invention.
Figure 11:
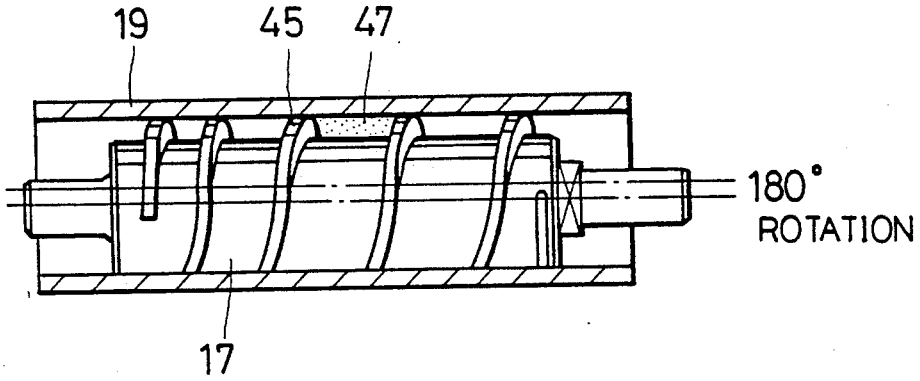
FIG. 11 is a view showing a 180-degree turned state of the essential part of the compressor of the invention.
Figure 12:
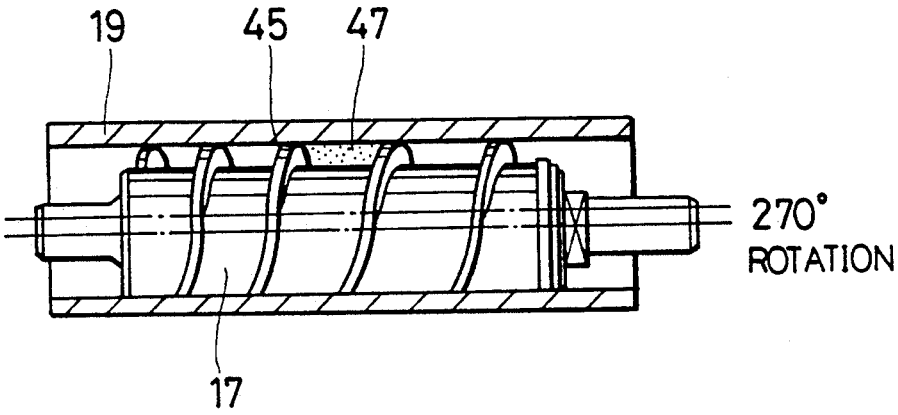
FIG. 12 is a view showing a 270-degree turned state of the essential part of the compressor of the invention.
Figure 13:
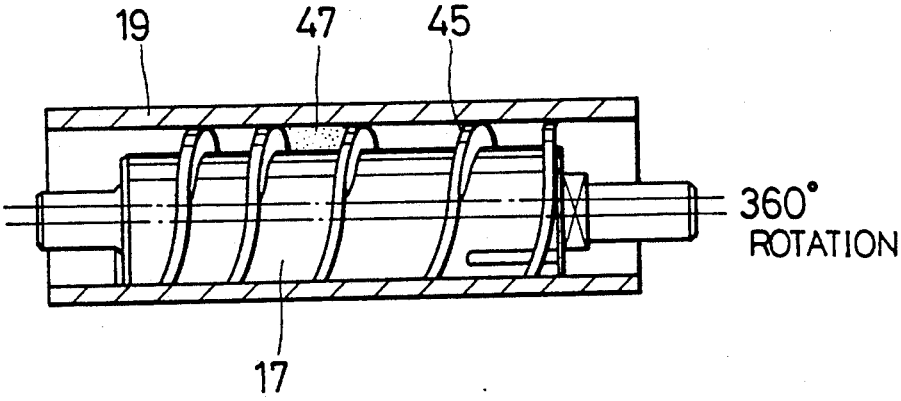
FIG. 13 is a view showing a 360-degree turned state of the essential part of the compressor of the invention.

In FIG. 10, the periphery of the blade 45 is in contact with the inner face of the cylinder 19. The blade 45 defines a plurality of work chambers 47 in a space between the inner face of cylinder 19 and the periphery of the piston 17. Each of the work chambers 47 is formed between adjacent two windings of the blade 45. Each work chamber 47 extends alone the blade 45 from one contact portion between the piston 17 and the cylinder 19 to the next contact portion between them to form a crescent shape.

As shown in FIG. 10, the volumes of the work chambers 47 gradually decrease from the suction port 23 toward the discharge port 21. Namely, the work chamber 47 at the suction port 23 has the largest volume, and the volumes gradually decrease toward the discharge port 21.

Returning to FIG. 7, the first work chamber 47 at the suction port 23 is connected to the suction pipe 5 of the refrigerating cycle through a suction hole 49 formed in the piston 17 and a path 51 formed in the bearing portion 25. Accordingly, the coolant gas is surely and continuously guided from the suction pipe 5 into the first work chamber 47 through the suction hole 49 in the cylinder 19.

On the other hand, the work chamber 47 at the discharge port 21 has the smallest volume. This work chamber is connected to the discharge port 21 which is open to the end of the cylinder 19.

The piston 17 has a lubricant path 53. One end of the lubricant path 53 is connected to the bottom of the spiral groove 43, and the other end thereof to a guide tube 55 having an opening at the bottom of the case 1. When pressure in the case 1 increases, a lubricant 56 stored on the bottom of the case 1 is supplied into the spiral groove 43 through the lubricant path 53, to help the blade 45 moving smoothly inwardly and outwardly in the groove 43.

An operation of the fluid compressor will be explained.

The drive unit 9 is energized to turn the rotor 15 and cylinder 19 together. The piston 17 is then turned through the oldham ring 33. Since the piston 17 is eccentric to the cylinder 19, a relative speed difference occurs between the inner face of the cylinder 19 and the periphery of the piston 17. The relative speed difference changes in a one-turn period of the cylinder 19, to supply the coolant gas into the work chamber 47 located in the vicinity of the suction port 23. The coolant is successively transferred and compressed through the work chambers 47 and discharged into the discharge pipe 7 from the work chamber 47 located in the vicinity of the discharge port 21.

According to the invention, the outer diameter of the blade 45 is larger than the inner diameter of the cylinder 19 at least in the vicinity of the suction port 23. This configuration provides the blade 45 with a strong restoring force, which pushes the blade 45 against the inner face of the cylinder 19. Even if the large twists of the blade 45 produce large slide resistance between the blade 45 and the wall of the spiral groove 43, the strong restoring force surely makes the periphery of the blade 45 be in contact with the inner face of the cylinder 19, to tightly seal the work chambers 47.

In summary, the invention provides a spiral blade type fluid compressor involving large blade pitches to increase discharge capacity. Even if these large pitches of the blade cause large twists on the blade, the blade of the invention will be in tight contact with the inner face of a cylinder, to surely seal work chambers.

Various modifications will become possible for those skilled in the art after receiving the teachings of the present disclosure without departing from the scope thereof.

What is claimed is:

1. A fluid compressor for drawing, compressing, and discharging a fluid, comprising:

(a) a cylinder rotated by drive means and having a suction port for drawing the fluid and a discharge port for discharging the fluid;

(b) a cylindrical piston eccentrically disposed inside said cylinder so that the periphery of said piston is partly in contact with the inner face of said cylinder, said piston being movable relative to said cylinder;

(c) a spiral groove formed around the periphery of said piston at pitches that gradually reduce from the suction port side toward the discharge port side; and (d) a spiral blade fitted in said groove so that said blade is outwardly and inwardly movable in said groove, said blade defining a plurality of work chambers between the inner face of said cylinder and the periphery of said piston;

wherein the outer diameter of at least part of said blade is larger than the inner diameter of said cylinder and said blade is tapered so that the outer diameter of said blade gradually increases from the discharge port side toward the suction port side where said blade has a largest pitch.

2. A fluid compressor for drawing a fluid through a suction port, compressing the fluid, and discharging the compressed fluid through a discharge port, comprising:

a supporting structure;

a cylinder having an inner cylindrical surface and being rotatably supported around a first rotation axis by said structure;

a cylindrical piston having an outer cylindrical surface with a diameter smaller than a diameter of the inner cylindrical surface of said cylinder, said cylindrical piston being supported by said supporting structure around a second rotation axis parallel to but displaced from said first rotation axis so that the outer cylindrical surface of said piston makes contact with the inner cylindrical surface of said cylinder at a contact line extending parallel to said first and second axes; and a helical blade having 1) a pair of ends, and 2) a pitch decreasing from one of said pair of ends that is located proximate to the suction port to the other of said pair of ends that is located proximate to the discharge port, said helical blade being interposed in a space defined between the inner cylindrical surface of said cylinder and said outer cylindrical surface of said piston to partition said space into a plurality of work chambers;

wherein said helical blade has an outer diameter proximate to said suction port and a second outer diameter proximate to said discharge port, and said first outer diameter is larger than said second outer diameter.

3. A fluid compressor as recited in claim 2, wherein the outer diameter of said helical blade increases in proportion to the increase in said pitch.

4. A fluid compressor as recited in claim 2, wherein said first outer diameter is constant for a predetermined length of said helical blade.

5. A fluid compressor as recited in claim 2, wherein said first outer diameter is the only diameter of the helical blade which is larger than said diameter of said inner cylindrical surface.

* * * * *